United States Patent [19]

Liu

[11] Patent Number: 4,995,248

[45] Date of Patent: Feb. 26, 1991

[54] CONTROL MECHANISM OF ELECTRONIC LOCK HAVING DOUBLE BOLTS

[76] Inventor: Yin-Chic Liu, P.O. Box 10160, Taipei, Taiwan

[21] Appl. No.: 509,905

[22] Filed: Apr. 16, 1990

[51] Int. Cl.[5] ..... E05B 47/06; E05B 59/00

[52] U.S. Cl. ..... 70/107; 70/277; 70/278; 70/283

[58] Field of Search ..... 70/107, 276–278, 70/280–282, 283

[56] References Cited

U.S. PATENT DOCUMENTS

| | | | |
|---|---|---|---|
| 3,926,021 | 12/1975 | Genest et al. | 70/278 |
| 4,129,019 | 12/1978 | Urdal | 70/107 |
| 4,183,563 | 1/1980 | Stevens | 70/107 X |
| 4,519,228 | 5/1985 | Sornes | 70/278 X |
| 4,641,868 | 2/1987 | Miron | 292/336.3 |
| 4,656,850 | 4/1987 | Tabata | 70/276 |
| 4,672,826 | 6/1987 | Mombelli | 70/278 |
| 4,820,330 | 4/1989 | Lin | 70/277 |

FOREIGN PATENT DOCUMENTS

| | | | |
|---|---|---|---|
| 2159568 | 12/1985 | United Kingdom | 70/278 |

*Primary Examiner*—Lloyd A. Gall

[57] ABSTRACT

An electronic lock comprises an outside cover having a sensor formed in the cover, an inside cover, a base having batteries stored in the base, a control device and two bolts of which a latch bolt can be retracted or extended for opening or closing a door when the door is not locked and a dead bolt can be operated by a thumbturn formed in the inside cover, and upon an insertion of a correct coded number card to sense the sensor to actuate an electromagnetic coil of the control device, the dead bolt can be operated for unlocking or locking the door from outside a door.

12 Claims, 5 Drawing Sheets

CONTROL MECHANISM OF ELECTRONIC LOCK HAVING DOUBLE BOLTS

BACKGROUND OF THE INVENTION

U.S. Pat. No. 4,820,330 invented by Jui-Chang Lin discloses a structure for controlling the dead bolt used in an electronic lock which however has the following drawbacks:

1. When the cross rod 441 is to be retreated to the outside of rail 49, the upper round part of the cross rod 441 is moved from the engaged notch 493 of the rail 49 to the inclined way 494 to compress the springs 492 of the rail 49 as urged by the spring 43 jacketed on the moving base 44, thereby easily causing an elastic fatigue of the spring 43 after a long time operation of the lock.

Since the cross rod 441 should be operatively engaged with the grooves 452 of engaging disc 45 and the grooves 463 of the engaging base 46 for opening the lock from the outside knob 11, each groove 452 or 463 is preferably made as an outwardly enlarged arcuate shape for smoothly engaging the cross rod 441. However, such an arcuate groove (port) may not carry the upper round part of the cross rod 441 to sharply match the notch 493 of rail 49 when opening the lock. Once an elastic fatigue is caused to the spring 43, the upper round part of the cross rod 441 even urged by the spring 43 may be frictionally retarded on the rail surface 49 and can not be poked into the notch 493 to engage the grooves 452 of disc 45, unable for opening the lock.

2. So many elements of the base plate 3 and moving parts 4 are provided to increase production cost and maintenance problems of a complete lock. The so many elements of the lock may also increase their production complexity. Also, many elements in construction of the lock may not be operated very smoothly as expected. For instance, the cross rod may not be precisely operated in cooperation with the rail to cause malfunction or false action. So many springs may also be counteracted with each other to easily cause fatigue failure to possibly lose their normal effects, thereby causing the maintenance problems. The present inventor has found such drawbacks and invented the present lock with some improvements thereover.

U.S. Patent Application entitled "Control Mechanism of Electronic Lock" filed on Jan. 22, 90 by the same applicant of this application with a Ser. No. 07/468,058 discloses a locking mechanism provided with only a single latch bolt so that the applicant expects to disclose a lock having a dead bolt and a latch bolt for enhanced security purpose.

SUMMARY OF THE INVENTION

The object of the present invention is to provide a control mechanism of an electronic lock including an outside cover, an inside cover, a base, a control means and two bolts for more convenient locking or unlocking operation for a door, also for simpler construction and minor maintenance problems.

DETAILED DESCRIPTION

Figure 1:
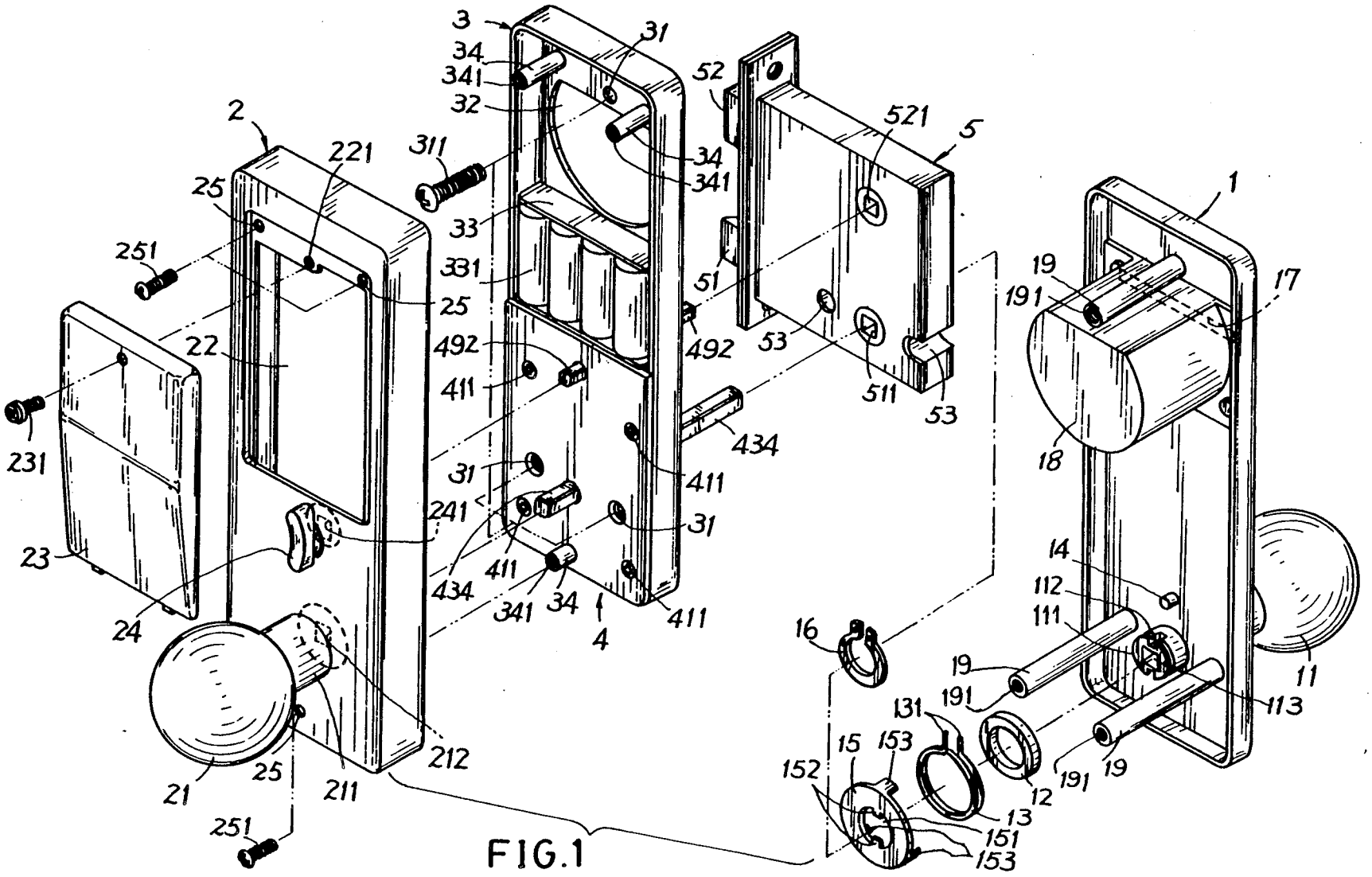
FIG. 1 is an exploded view of the present invention.

As shown in FIGS. 1-7, the present invention comprises: an outside cover 1, an inside cover 2, a base 3, a control means 4 and a locking bolt means 5.

As shown in FIG. 1, the outside cover 1 is rotatably mounted with an outside knob 11 having a rotating shaft 111 pivotally mounted in the cover 1. A washer 12 and a restoring spring 13 are jacketed on the shaft 111 inside the cover 1. Two spring ends of the spring 13 are crosswise separated by a protrusion 14 formed on a central inside wall of the cover 1 above the shaft 111 or disposed on a stem 19 formed on the cover 1 as shown in dotted line of FIG. 5. A restoring retainer 15 includes a central hole 151 having two lugs 152 radially protruding from the hole 151 to be engage with two notches 112 formed in an inner portion of the shaft 111, a plurality of pawls 153 longitudinally formed on a perimeter of the retainer 15 for defining the spring 13 and washer 12 therein, of which a pawl 153 is inserted between the two spring ends 131 of the spring 13 so as to normally maintain a specific orientation of the knob 11 rotatably mounted in the cover 1. A square hole 113 is formed in an inner end portion of the shaft 111. An inner retainer 16 is further provided to limit the retainer 15, the spring 13 on the shaft 111. The pawls 153 may be obstructed by the spring ends 131 when the retainer 15 is rotated to prevent a wide-range rotation of the knob 11. A sensor 18 is fixed inside the cover 1 for checking and reading a coded number card C insertable in a slot 17 formed in an outside cover 1. A plurality of stems 19 are formed inside the cover 1 for connecting the base 3.

The inside cover 2 includes an inside knob 21 having a rotating shaft 211 rotatably mounted in the inside cover 2 projectively aligned to the outside knob 11, a window 22 formed in the cover 2, a window shield 23 covering the window 22 and fixed on the cover 2 by a screw 231 engaged with a screw hole 221 formed in the cover 2, and a thumbturn 24 rotatably secured on the cover 2. A square hole 212 is formed in an inner end portion of the shaft 211, whereas another square hole 241 is formed on an inside surface of the thumbturn 24.

Figure 3:
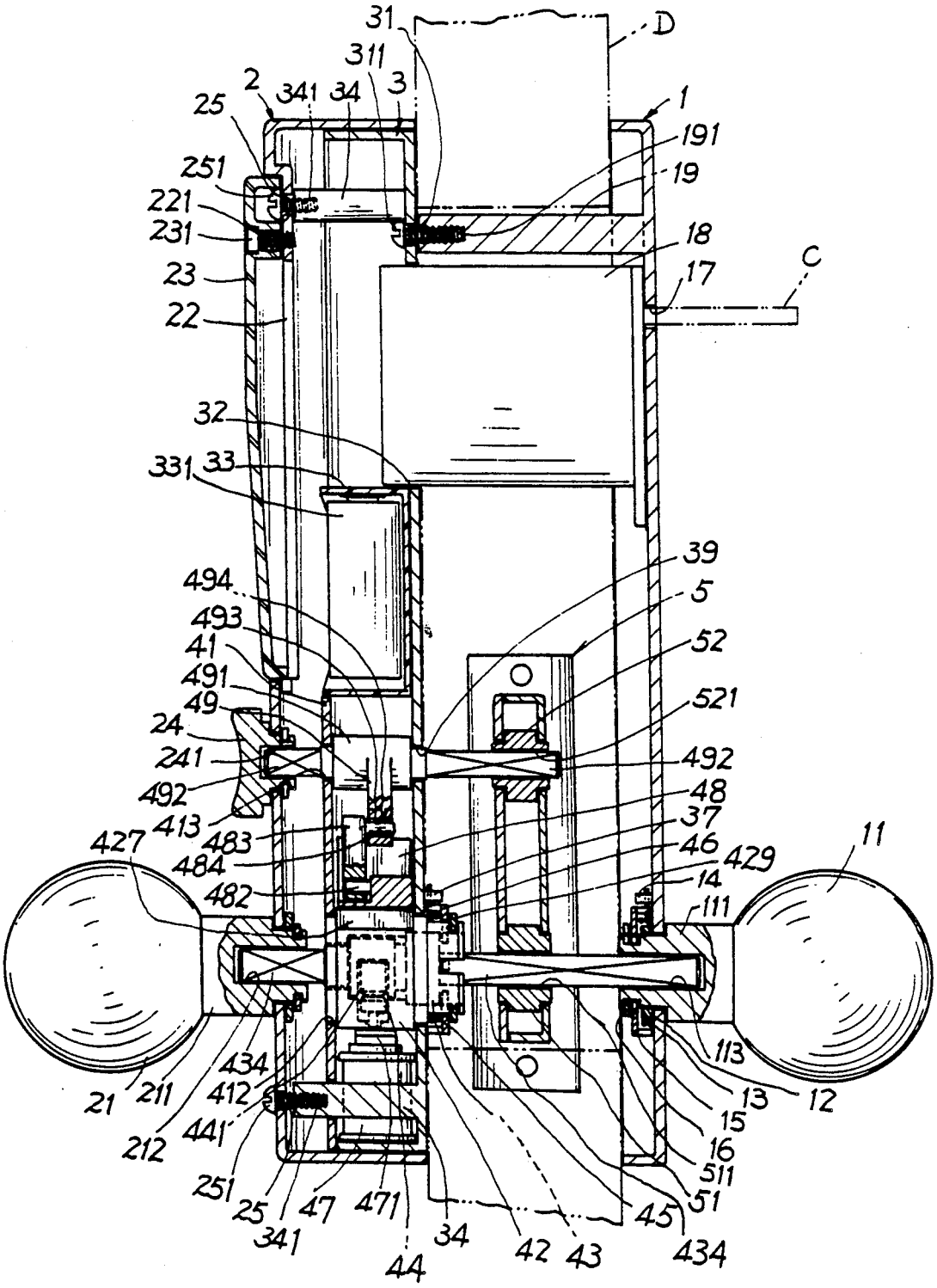
FIG. 3 is a sectional drawing of the present invention as assembled.

The base 3 includes a plurality of stem holes 31 each for inserting a screw 311 therethrough for securing the base 3 to the outside cover 1 as spaced by a door D as shown in FIG. 3 in which the screw 311 engages the screw hole 191 formed in each stem 19, a sensor hole 32 for storing the sensor 18 fixed on the cover 1, a battery socket 33 formed in the base 3 for storing a plurality of dry batteries 331 therein for powering the sensor 18, and a plurality of stem 34 protruding towards the inside cover 2 from the base 3 for inserting a plurality of screws 251 through screw holes 25 formed in cover 2 and engaging holes 341 formed in the stems 34 for securing the base 3 to the cover 2 for shielding the base 3 within a door D by the cover 2.

Figure 2:
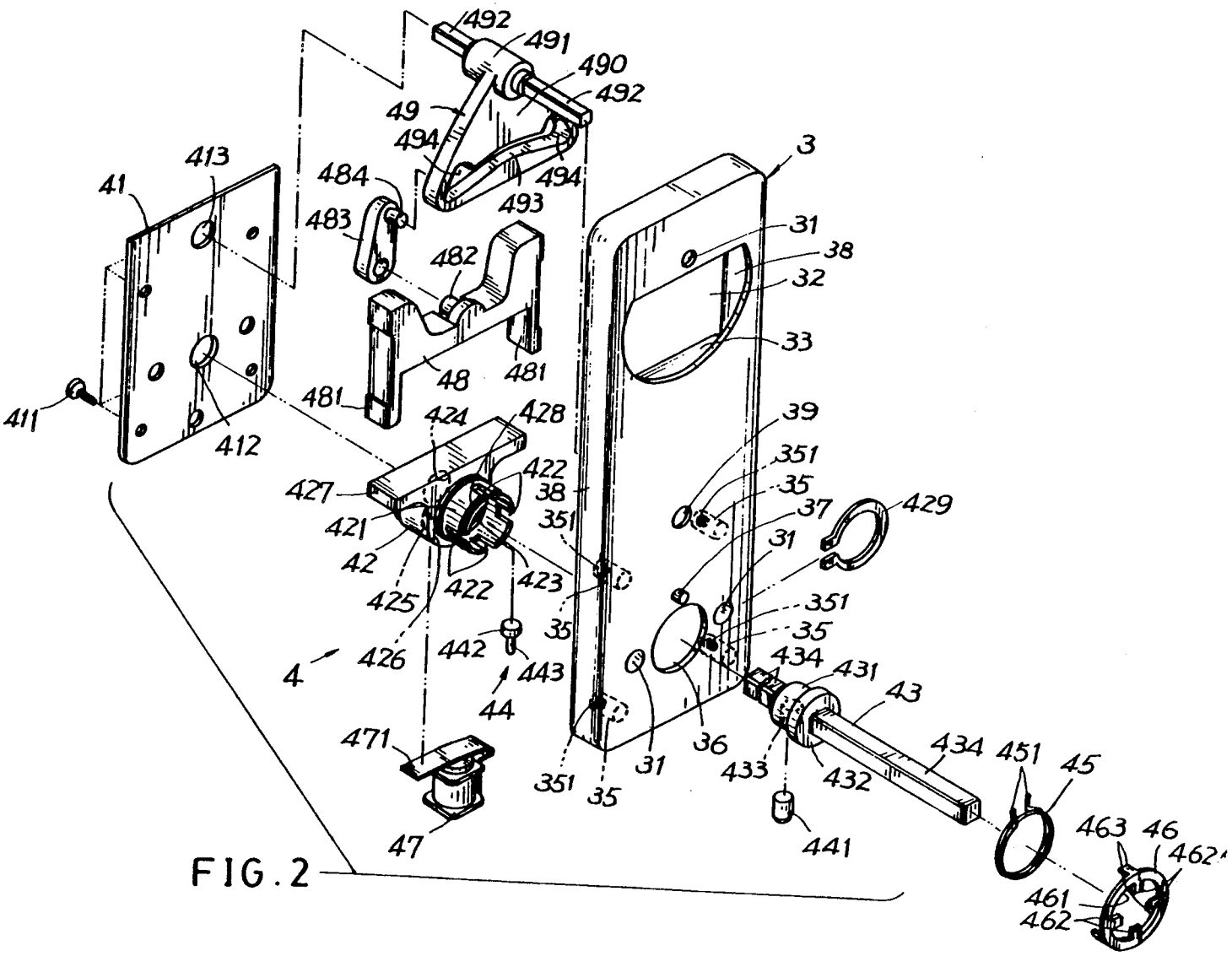
FIG. 2 is an exploded view showing partial elements of the present invention.
Figure 4:
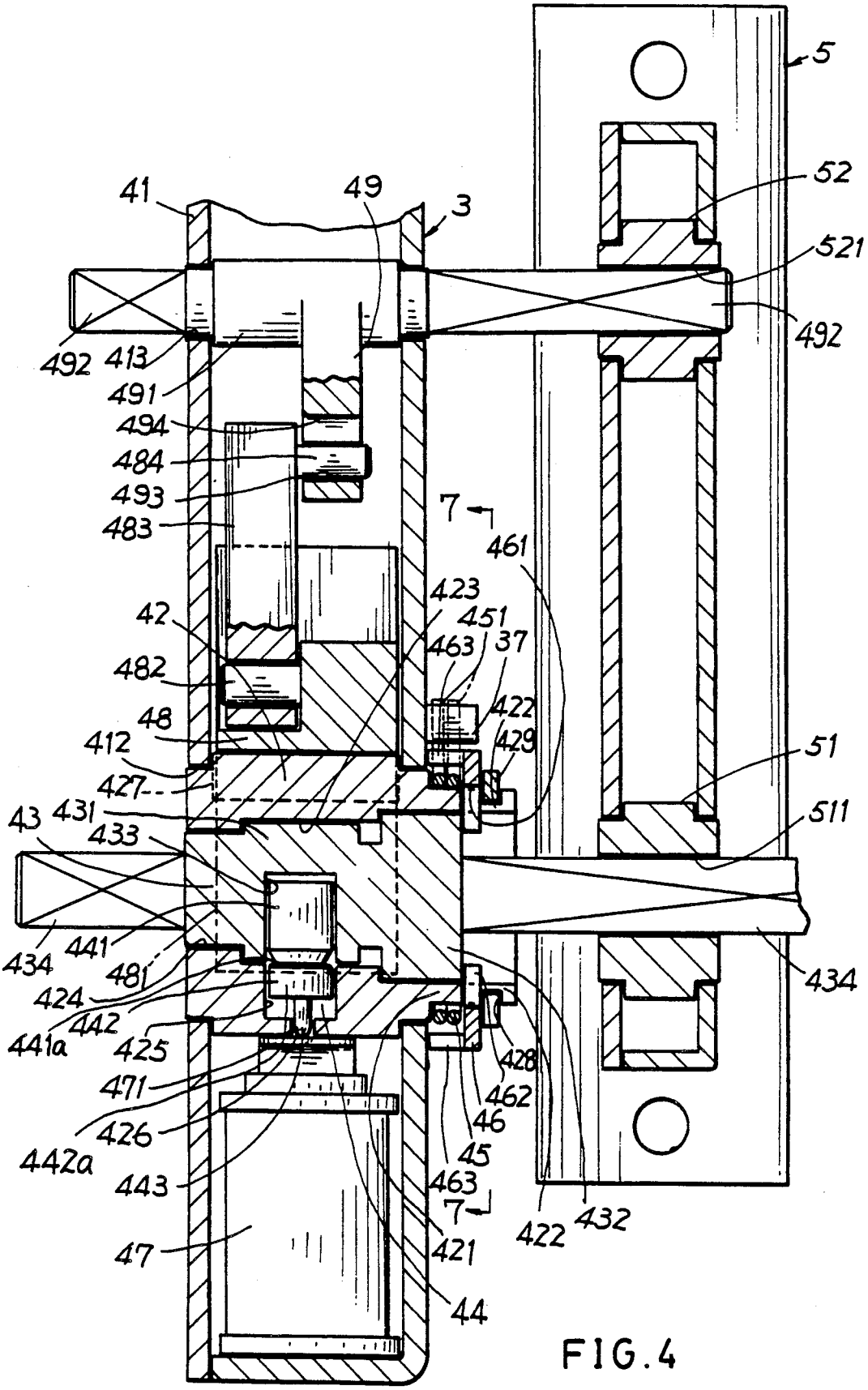
FIG. 4 is a detailed sectional illustration of the present invention when assembled.

A shown in FIGS. 2, 3, 4, the control means 4 operated by the outside knob 11 or inside knob 21 respectively formed on outside cover 1 and inside cover 2 inlcudes: a covering plate 41, a rotating cylinder 42, a rotating axle 43, a tumbler set 44, a restoring spring 45, a restoring retainer ring 46, an electromagnetic coil 47, a counterweight rider 48, and a bolt positioning member 49.

The fixing plate 41 is secured to the base 3 by fixing screws 411 through holes formed in the plate 41 and holes 351 in stems 35 on the base 3 so as to rotatably mount the rotating cylinder 42 in a hole 412 formed in the plate 41 and the other hole 36 formed in base 3, having a longitudinal axis of the cylinder 42 coaxially aligned with a longitudinal axis of the inside, outside knobs 21, 11.

The rotating cylinder 42 includes a transmission sleeve 421 protruding outwardly through the hole 36 having a plurality of notches 422 formed in the sleeve 421, a cylindrical recess 423 formed in the cylinder 42, a central hole 424 formed in an inner side of the cylinder 42 near the fixing plate 41 communicated with the recess 423, a vertical cylindrical hole 425 formed in a lower portion of the cylinder 42 communicated with the recess 423 and followed by a tip hole 426 under the hole 425 to communicate the hole 425 and an outside cylindrical surface of the cylinder 42 and a horizontal plate 427 laterally formed on an upper portion of the cylinder 42.

The rotating axle 43 includes a cylindrical head portion 431 and a flange 432 respectively rotatably engageable with the recess 423 and sleeve 421 of the cylinder 42, a vertical cylindrical recess 433 recessed in a lower portion of the head portion 431 corresponding to the cylindrical hole 425 in the cylinder 42, and a square shaft 434 having two shaft portions respectively protruding inwardly from the head portion 431 and the flange 432 to pass through the central hole 424 of the cylinder 42 and through an axle hole 511 of a latch bolt 51 of the locking bolt means 5 to be finally secured to the two square holes 212, 113 of the inside knob 21 and outside knob 11. The restoring spring 13 and pawls 153 if the outside knob 11 will always orient the recess 433 of the cylindrical head portion 431 vertically downwardly.

Figure 7:
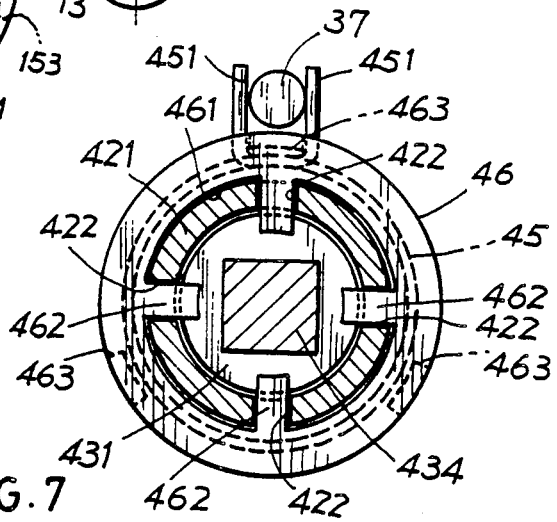
FIG. 7 is a cross sectional view from 7—7 direction of FIG. 4.

The restoring spring 45 is jacketed on the sleeve 421 having two spring ends 451 crosswise retained on a stem 37 formed on the base 3. The restoring retainer ring 46 as shown in FIG. 7 includes a central hole 461 slidably engaged with the sleeve 421, a plurality of lugs 462 radially formed on the ring correspondingly engaged with the notches 422 of the sleeve 421 and for limiting the flange 432 of the axle 43, and a plurality of pawls 463 longitudinally protruding from the retainer ring having one pawl 463 inserted between the two spring ends 451 crosswise retained on a stem 37 so as to normally align the recess 433 with the hole 425. An outermost retainer ring 429 is engaged with an annnular groove 428 formed on an outer portion of the sleeve 421 to limit the ring 46, spring 45 as abovementioned.

The tumbler set 44 includes an upper tumbler 441 normally held in the recess 433 in the cylindrical head portion 431 and a lower tumbler 442 having an upper cylindrical disk **442*a* and a lower tip 443 formed under the disk 442*a*. The lower tumbler 442 is normally kept in the holes 425, 426 as supported by a spring plate 471 of the coil 47. The tip 443 may be reciprocated in the tip hole 426. The spring plate 471 normally urges the tip 443 upwardly without being protruded downwardly from the hole 425 to form a rotational interface 441*a* defined between the upper tumbler 441 and the lower tumbler 442 as shown in FIGS. 3, 4. The electromagnetic coil 47 is fixed on the base 3 to be controlled by the sensor 18 and is positioned under the rotating cylinder 42**.

The counterweight rider 48 is overlain on the horizontal plate 427 having two vertical legs 481 vertically formed on two opposited end portions of the plate 48 engageable with two end portions of the plate 427, and a pivot 482 formed on an upper portion of the rider 48 for pivotally connecting a biasing arm member 482 having a biasing pin 484 formed on an upper portion of the arm member 483. The two vertical legs 481 are slidably guided in two side walls 38 of the base 3 for a stable up-and-down movement when biased by the horizontal plate 427.

The bolt positioning member 49 includes a general triangular plate 490 having a pivoting shaft 491 formed on the plate 490 pivotally secured in a hole 413 of the plate 41 and a hole 39 of the base 3 and having two square rods 492 respectively fixed in a square hole 241 of the thumbturn 24 and in a rod hole 521 of a dead bolt 52 of the locking bolt means 5, an arcuate slot 493 formed in a lower portion of the plate 490 being slightly convex upwardly, and two pin notches 494 formed on two opposite end portions of the slot 493 to be biased by the biasing pin 484 of the arm member 483.

The locking bolt means 5 includes two fixing holes 53 for fixing the locking bolt means 5 on two stems 19 of the outer cover 1 and into the door D, a latch bolt 51 formed on a lower portion in the locking bolt means 5 normally protruding outwardly as urged by a restoring spring formed inside the means 5 which can be retracted for opening the door D when rotating either the outside knob 11 or the inside knob 21, and a dead bolt 52 formed on an upper portion of the locking bolt means 5 which bolt 52 can be protruded outwardly or retracted inwardly by rotating the thumbturn 24 by rotating the outside knob 11 when inserting a coded card into the sensor 18 for coupling the axle 43 with the cylinder 42.

In using the present invention, the outside knob 11 or inside knob 21 can be rotated to retract the latch bolt 51 when it is unlocked to open or close the door.

When the door is locked, anyone inside the door can turn the thumbturn 24 to retract or extend the dead bolt 52 for unlocking or locking the door. Or, a coded card C is inserted into the slot 17 to actuate the sensor 18 from outside the door, the electromagnetic coil 47 will be powered to electromagnetically attract the spring plate 471 downwardly to drop the tip 443 of the lower tumbler 442 and drop the upper tumbler 441 to intersect the interface **441*a* to couple the cylindrical head portion 431 of axle 43 and the cylinder 42 so that upon a rotating of the outside knob 11 to rotate the axle 43, the cylinder 42 will be rotated to bias the horizontal plate 427 as shown in dotted line in FIG. 6, thereby raising the rider 48 to bias (direction S) the triangular plate 490 of the bolt positioning member 49 to rotate (direction R) the shaft 491 to extend the dead bolt 52 outwardly (direction O) to lock the door D. At this moment, the pin 484 of the arm member 48 may slide away along the arcuate slot 493 downwardly (direction S1) to a lower position to gravitionally drop the arm member 483 and the rider 48 until resting on the horizontal plate 427 of the cylinder 42. The gravitational force of the counterweight rider 48 as pendent on the lower notch 494 of the plate 490 will stably bias the plate 490 to urge the extending of the dead bolt 52** at its extending locking position (O) for locking purpose.

Figure 6:
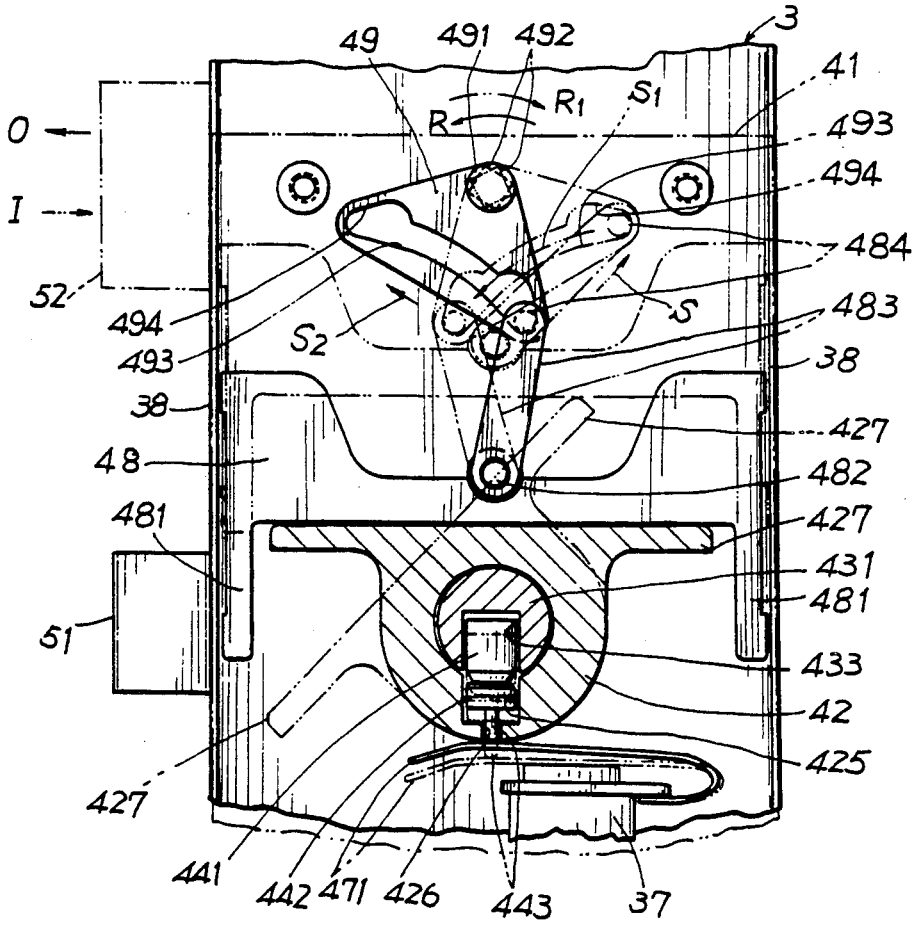
FIG. 6 is a front view illustration of FIG. 4.
Figure 5:
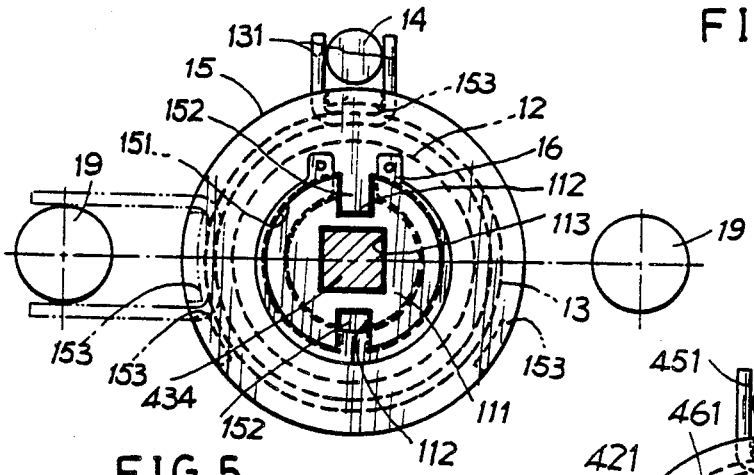
FIG. 5 is an illustration showing an inside surface of an outside knob of the present invention.

If the user wants to reopen the door from outside the door, he (she) may reinsert the card to power the coil 47 for coupling the axle 43 with the cylinder 42 and then rotate the outside knob 11 for biasing the horizontal plate 427 to raise the rider 48 and bias the arm member 483 and triangular plate 490 in direction S2 as solid line shown in FIG. 6 thereby rotating shaft 491 in direction R1 and retracting bolt 52 inwardly (I) for opening the door.

The restoring spring 13, washer 12, retainers 15, 16 may also be formed on the inside knob 21 (not shown).

Accordingly, the present invention has the following advantages superior to any conventional electronic lock:

1. The structure is simple for easier assembly and maintenance of the lock. The construction elements of this invention are reduced to decrease the production cost thereof.

2. The transmission or driving force for opening or closing the door is so smooth by engagement or disengagement of revelant cylindrical elements for a preciser and more convenient operation.

3. A switching operation can directly actuate the bolts 51, 52 for quicker and more efficient opening or closing of a door.

I claim:

1. A control mechanism of electronic lock comprising:

an outside cover fixed on an outside surface of a door having an outside knob rotatably mounted in said outside cover and a sensor fixed on an inside surface of the outside cover operatively reading a coded number card inserted through a slot formed in said outside cover;

an inside cover corresponding to said outside cover fixed on an inside surface of the door having an inside knob rotatably mounted in said inside cover and a thumbturn pivotally formed in said inside cover;

a base secured between said outside cover and said inside cover having a battery socket for storing batteries therein for powering said sensor;

a locking bolt means having a latch bolt formed on a lower portion of the locking bolt means normally resilently protruding outwardly and a dead bolt formed on an upper portion of the locking bolt means; and a control means operatively retracting or extending said two bolts when actuated by the sensor reading a correct coded card for opening or closing the door, said thumbturn operatively retracting or extending said dead bolt for unlocking or locking the door, said control means including a fixing plate secured to said base between said outside cover and inside cover, a rotating cylinder rotatably mounted in said fixing plate and said base, a rotating axle rotatably engageable in said cylinder and secured to both said outside knob and said inside knob by passing through said latch bolt for operatively retracting said latch bolt for opening the door when the dead bolt is unlocked, said rotating cylinder rotating engageabble with said axle, a tumbler set operatively coupling said cylinder with said axle, a restoring spring restoring said cylinder for a specific orientation of said cylinder, an electromagnetic coil formed under said cylinder operatively coupling said cylinder with said axle when powered by said batteries as sensed by said sensor, a counterweight rider normally overlain on said cylinder pivotally mounted with a biasing arm member thereon, and a bolt positioning member pivotally connected between said fixing plate and said base operatively biased by said arm member of said counterweight rider, when rotating said outside knob, said axle, and said cylinder to bias and raise said rider, for rotating said bolt positioning member for retracting said dead bolt for opening the door.

2. A control mechanism of electronic lock according to claim 1, wherein a knob restoring spring is formed on a shaft of said outside knob for normally orienting said axle in a specific direction.

3. A control mechanism of electronic lock according to claim 1, wherein said rotating cylinder of said control means includes a transmission sleeve protruding towards said outside cover having a cylindrical recess formed in an outer side thereof, a central hole formed in an inner side opposite to and communicated with said cylindrical recess, a vertical cylindrical hole formed in a lower portion of said cylinder having a tip hole formed under and communicated with the vertical cylindrical hole through the cylinder, and a horizontal plate formed on an upper portion of the cylinder.

4. A control mechanism according to claim 3, wherein said transmission sleeve is formed with a plurality of notches therein to be engaged with a plurality of lugs radially formed on a restoring retainer ring jacketed thereon, said restoring retainer ring normally restoring said cylinder to orient said vertical cylindrical hole vertically as restored by said restoring spring.

5. A control mechanism according to claim 1, wherein said rotating axle includes a cylindrical head portion rotatably engageable with said cylindrical recess in said cylinder, a flange secured with said cylindrical head portion rotatably engageable with said sleeve of said cylinder, a square shaft having an inner shaft portion protruding inwardly from said cylindrical head portion to pass through said central hole in said cylinder to be secured to said inside knob and having an outer shaft portion protruding outwardly from said flange to engage a shaft hole formed in said latch bolt to be fixed to said outside knob, said cylindrical head portion formed with a vertical cylindrical recess in its lower portion normally aligned with said vertical cylindrical hole in said cylinder as restored by said knob restoring spring formed in said outside knob.

6. A control mechanism according to claim 5, wherein said vertical cylindrical recess is stored with an upper tumbler of the tumbler set therein.

7. A control mechanism according to claim 3, wherein said vertical cylindrical hole in said cylinder is movably stored with a lower tumbler of the tumbler set therein, said lower tumbler having a lower tip formed under an upper disk of said lower tumbler, said lower tip movably held within a lower tip hole formed under said vertical cylindrical hole in said cylinder.

8. A control mechanism according to claim 7, wherein said lower tumbler is normally supported by a spring plate formed on said electromagnetic coil to form a rotational interface defined between said cylindrical head portion stored with said upper tumbler and said cylinder stored with said lower tumbler for a free rotation of said axle within said cylinder, said spring plate being operatively attracted downwardly when actuating said coil to drop said lower tumbler and said upper tumbler, intersecting the rotational interface for coupling said cylinder and said axle for operating said dead bolt for locking or unlocking said door.

9. A control mechanism according to claim 1, wherein said counterweight rider includes two vertical legs formed on two opposite end portions of the rider normally resting on an engageable with two opposite end portions of a horizontal plate of said cylinder, said biasing arm member pivotally mounted on an upper portion of said rider having a biasing pin formed on an upper portion of said arm member, said two legs of said rider slidably held in two side walls of said base.

10. A control mechanism according to claim 1, wherein said bolt positioning member includes a general triangular plate having a pivoting shaft formed on an upper portion of the triangular plate pivotally mounted on said fixing plate and said base having an inner rod secured to said pivoting shaft and said thumbturn and an outer rod secured to said pivoting shaft and said dead bolt, an arcuate slot formed in a lower portion of said triangular plate for slidably engaging a biasing pin of said arm member of said rider, and two pin notches formed on two opposite ends of the arcuate slot to be biased by the biasing pin of the arm member.

11. A control mechanism according to claim 10, wherein said arcuate slot is slightly convex upwardly.

12. A control mechanism according to claim 4, wherein said restoring retainer ring includes a plurality of pawls longitudinally formed on said ring, having one pawl inserted between two spring ends of said restoring spring jacketed on said sleeve of said cylinder, two said spring ends being crosswise retained on a stem formed on said base for resilently orienting said retainer ring and said cylinder.

* * * * *